US008513550B2

(12) United States Patent
Chen

(10) Patent No.: US 8,513,550 B2
(45) Date of Patent: Aug. 20, 2013

(54) MOVABLE CONTACT ASSEMBLY FOR ELECTRICAL SWITCH

(75) Inventor: De Zhou Chen, Wuxi (CN)

(73) Assignee: Siemens Aktiengesellschaft, Munich (DE)

( * ) Notice: Subject to any disclaimer, the term of this patent is extended or adjusted under 35 U.S.C. 154(b) by 408 days.

(21) Appl. No.: 12/839,828

(22) Filed: Jul. 20, 2010

(65) Prior Publication Data

US 2011/0024272 A1 Feb. 3, 2011

(30) Foreign Application Priority Data

Jul. 29, 2009 (CN) ..... 2009 1 0160860

(51) Int. Cl.
*H01H 19/00* (2006.01)
*H01H 19/11* (2006.01)
*H01H 19/58* (2006.01)

(52) U.S. Cl.
USPC ..... 200/11 R

(58) Field of Classification Search
USPC ..... 200/303, 400, 401, 565–569, 571
See application file for complete search history.

(56) References Cited

U.S. PATENT DOCUMENTS 3,187,287 A * 6/1965 Weidenman ..... 338/163
4,016,387 A * 4/1977 Aberer ..... 200/303
6,259,338 B1 7/2001 Boeder et al.
6,933,814 B2 * 8/2005 Ciarcia et al. ..... 335/8
2004/0021536 A1 2/2004 Harmon et al.
2008/0087532 A1 4/2008 Besana et al.

FOREIGN PATENT DOCUMENTS

CN 101162668 A 4/2008
CN 101176178 A 5/2008
EP 1037239 A2 9/2000
WO WO 03/050830 A1 6/2003
WO WO 2006/120149 a1 11/2006

OTHER PUBLICATIONS

Chinese Office Action dated Jan. 17, 2013 corresponding to Application No. 2009-10160860.0

* cited by examiner

*Primary Examiner* — Renee Luebke
*Assistant Examiner* — Lheiren Mae Caroc
(74) *Attorney, Agent, or Firm* — Harness, Dickey & Pierce, PLC

(57) ABSTRACT

A movable contact assembly for an electrical switch includes a movable contact and a pair of supports, each support including a bottom face and a support body perpendicular thereto. Each support body includes: a cavity for holding the movable contact disposed symmetrically at each end of a diameter of the bottom face, an inner and outer hook pair extending along the axis of the support body and being disposed symmetrically to the two sides of the diameter; and a projecting tongue and recess pair extending along the axis of the support body and being disposed symmetrically to the two sides of the diameter. The movable contact-holding cavity can hold the movable contact, the two supports can engage with each other in the direction of the axis, and the pair of the supports and the movable contact are assembled together to form the movable contact assembly.

5 Claims, 4 Drawing Sheets

MOVABLE CONTACT ASSEMBLY FOR ELECTRICAL SWITCH

PRIORITY STATEMENT

The present application hereby claims priority under 35 U.S.C. §119 on Chinese patent application number CN 200910160860.0 filed Jul. 29, 2009, the entire contents of which are hereby incorporated herein by reference.

FIELD

At least one embodiment of the present invention generally relates to a movable contact assembly for an electrical switch and, particularly, to a movable contact assembly capable of being connected in series.

BACKGROUND

In electrical switch devices, movable contact elements are usually used to realize the switching on and off of circuits by connecting and disconnecting between movable and static contacts. In order to achieve a secure installation of a movable contact, currently there are two commonly used methods: one of which uses a thread to connect two supports, and the other is constructed using a relatively complicated assembly. The disadvantages of these two methods are that they need many parts, and have complicated structures, high costs, and low efficiency.

SUMMARY

At least one embodiment of the present invention is intended to provide a movable contact assembly, which can use fewer parts to realize the assembling of a movable contact, and is simple in structure and convenient for installation.

At least one embodiment of the present invention provides a series connection for a plurality of movable contacts, which is simple in structure, low in costs, and has high assembling efficiency.

In at least one embodiment, the present invention provides a movable contact assembly for an electrical switch, which comprises a movable contact and a pair of supports, with each support comprising a bottom face and a support body, and the support body having an axis perpendicular to the bottom face, wherein each support body comprises: a cavity for holding the movable contact disposed along the direction of the axis and being symmetrical in shape along a diameter of the bottom face; an inner and outer hook pair extending along the direction of the axis of the support body, with the shapes of the inner hook and the outer hook being adapted to each other and being symmetrically disposed to the two sides of the diameter; and a projecting tongue and recess pair extending along the direction of the axis of the support body, with the shapes of the projecting tongue and said recess being adapted to each other and disposed symmetrically to the two sides of said diameter.

In another movable contact assembly for an electrical switch according to at least one embodiment of the present invention, the bottom face of which has a connector which is positioned symmetrically with respect to the diameter and is complementary in shape. For example, the connector can be a convex tooth and a groove disposed symmetrically to the two sides of the diameter.

In another movable contact assembly for an electrical switch according to at least one embodiment of the present invention, the shape of the projecting tongue is arcuate.

In a further movable contact assembly for an electrical switch according to at least one embodiment of the present invention, the shape of the projecting tongue is rectangular.

In a further movable contact assembly for an electrical switch according to at least one embodiment of the present invention, the shape of the projecting tongue is polygonal.

In the movable contact assembly of at least one embodiment of the present invention, due to the use of the design of the inner hook and the outer hook as well as of the projecting tongue and the recess, the pair of supports is made engageable with each other along an axial direction in a radially symmetrical manner, that is to say, in which the inner hook of one support and the outer hook of the other support are hooked with each other, the projecting tongue of one support is inserted into the recess of the other support, and the two movable contact cavities of the pair of supports form a space for disposing the movable contact so as to hold the movable contact therein. A pair of supports and a movable contact can be conveniently assembled together, to form a movable contact assembly. At the same time, due to the hooking between the inner hook and the outer hook, the projecting tongue and the recess are not capable of separating from each other by way of their own actions, thus further increasing the degree of stability of the connection.

In addition, due to the fact that in the movable contact assembly of at least one embodiment of the present invention the shape of the bottom face is symmetric radially and complementarily, when the two support bodies are engaged with each other, the bottom faces of the two movable contact assemblies are also exactly symmetric radially, and due to the connector shapes on the bottom faces being complementary, the bottom faces of said two movable contact assemblies are just connected together securely. When in use, any number of movable contact assemblies can be combined together according to different needs. Compared with currently available movable contact assemblies, it has a simpler structure and lower costs, and quick and efficient assembling can be achieved.

BRIEF DESCRIPTION OF THE DRAWINGS

The following figures are only for describing and explaining the present invention schematically, without limiting the scope of the present invention, in which.

DESCRIPTION OF THE REFERENCE NUMERALS

Figure 1:
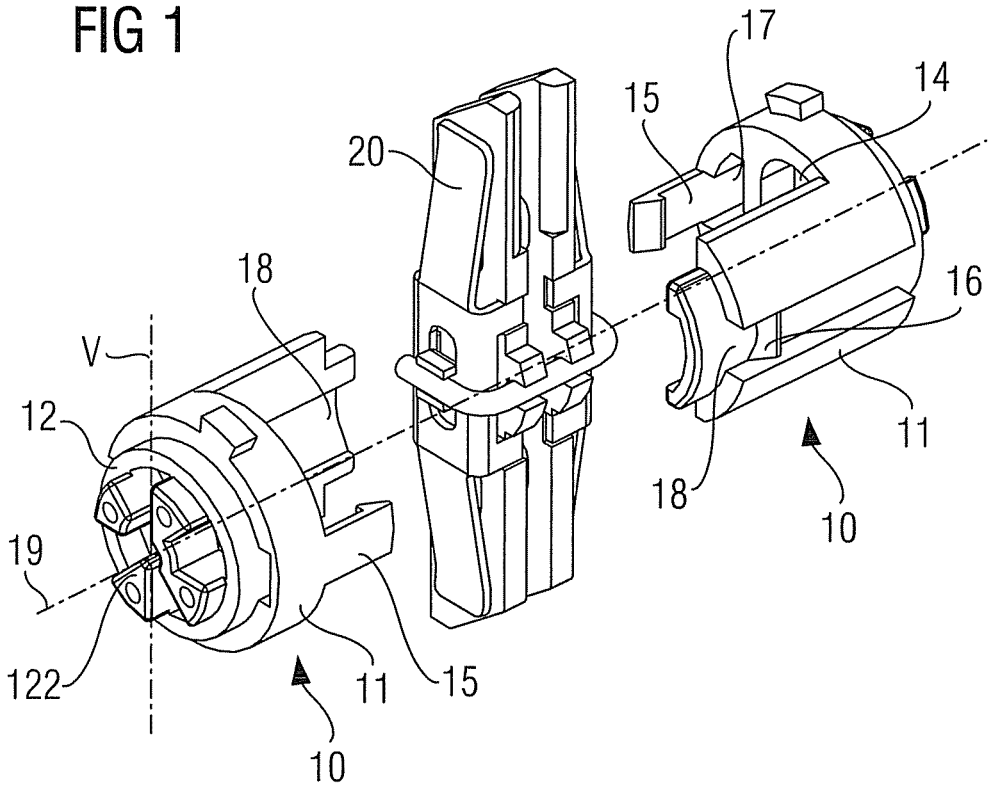
FIG. 1 is an exploded perspective view of a movable contact assembly for an electrical switch according to an embodiment of the present invention.

| | |
|---|---|
| 10 | support |
| 11 | support body |
| 12 | bottom face |
| 14 | movable contact-holding cavity |
| 15 | inner hook |
| 16 | outer hook |
| 17 | recess |
| 18 | projecting tongue |
| 122 | connector |
| 124 | convex tooth |
| 126 | groove |
| 20 | movable contact |
| 30 | electrical switch |

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In order to make the technical features, the objects and the effects of the present invention more clearly understood, particular embodiments of the present invention will now be described with reference to the accompanying drawings, in which identical reference numerals represent the same parts.

FIG. 1 is an exploded perspective view of a movable contact assembly for an electrical switch of an embodiment of the present invention, which comprises a movable contact 20 and a pair of supports 10, the pair of supports 10 being fitted through mutual connecting structures, so as to realize the secure assembling of the movable contact 20. Each support 10 has a bottom face 12 at its bottom part and a support body 11. The bottom face 12 presents a disk shape, usually a disk of a circular shape for the ease of manufacturing, and the bottom face 12 has a connector 122 of a complementary shape and being disposed radially in symmetry, so as to provide conditions for connecting a plurality of movable contact assemblies, the particular structure of the connector 122 being described in detail in FIG. 4.

Each support body 11 has an axis 19 perpendicular to the bottom face 12, and inside the support body 11 is provided a movable contact-holding movable contact holding 14 along the direction of the axis 19, so that when the two supports 10 are assembled, the two movable contact-holding cavities 14 form a cavity space, the shape of which is adapted to the movable contact 20, so it can hold therein the movable contact 20.

Around the movable contact-holding cavity 14, the support body 11 is also provided with an inner hook 15 with a hook head facing inwards and an outer hook 16 with a hook head facing outwards, with both the inner hook 15 and the outer hook 16 extending along the axis 19, being disposed symmetrically to the two sides of a diameter V of the bottom face 12, and being adapted in shape to each other, so that the inner hook and the outer hook of the two support bodies 11 can be hooked with each other. Around the movable contact holding cavity 14, the support body 11 is further provided with a projecting tongue 18 and a recess 17, with both the recess 17 and the projecting tongue 18 extending along the direction of the axis, at the same time also being disposed symmetrically to the two sides of the diameter V, and with both of them being adapted in shape to each other, so that the projecting tongue 18 and the recess 17 of the two support bodies 11 can be embedded into each other. The forms of the projecting tongue 18 and the recess 17 can be of any appropriate shape, such as an arc, a rectangle, or a polygon.

During the assembling of the movable contact assembly, two supports 10 of the identical structure are disposed along the direction of the axis and are symmetric with respect to the diameter V, with the movable contact 20 being placed between the opposing movable contact-holding cavities 14 of the two supports 10. The two supports 10 are moved relative to each other along the axis 19, during which the inner hook 15 of one support 10 and the outer hook 16 of the other support 10 are hooked to each other, and the projecting tongue 18 of one support 10 is inserted into the recess 17 of the other support 10, achieving a secure engagement. At the same time, the cavity space formed by the two movable contact-holding cavities 14 of the pair of supports 10 is adapted to the shape of the movable contact 20, thereby enabling the movable contact 20 disposed therein to be fixed securely. After the completion of the assembly, a movable contact assembly has two inner hook 15 and outer hook 16 pairs hooked together, and two projecting tongue and recess 17 pairs embedded into each other, not only realizing the secure engagement of the supports 10, but also being capable of transmitting a very high torque, and at the same time, the projecting tongue 18 and the recess 17 are unable to separate from each other by their own actions, due to the hooking engagement between the inner hook 15 and the outer hook 16, thereby further increasing the degree of stability of the connection.

Figure 2:
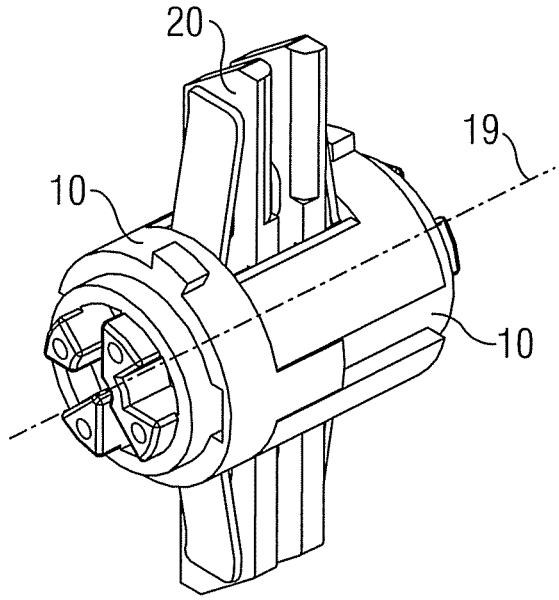
FIG. 2 is a perspective schematic view of the movable contact assembly shown in FIG. 1 after having been assembled.

FIG. 2 shows a structural schematic view of a movable contact assembly formed after having assembled the two supports 10 and a movable contact 20.

Figure 3:
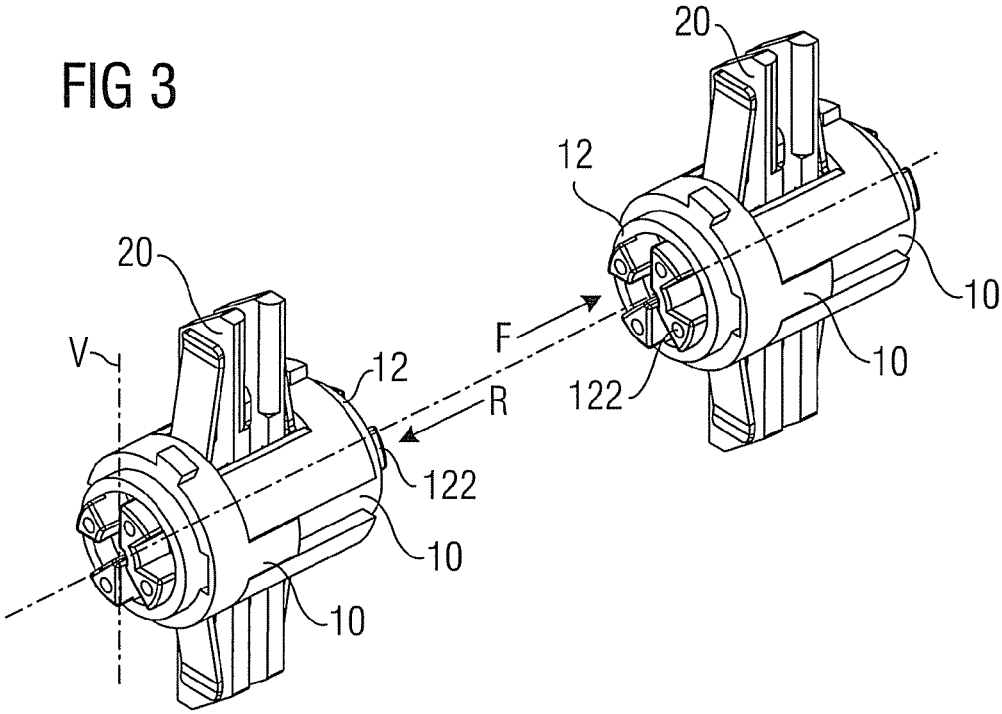
FIG. 3 is a schematic view showing the assembling of two movable contact assemblies shown in FIG. 2.

Depending on structural requirements of different electrical switches, there is sometimes a need for a plurality of movable contacts to be fitted with one another. The design of the bottom face 12 of the movable contact assembly of an embodiment of the present invention satisfies this need. FIG. 3 shows a schematic view in assembling two movable contact assemblies. As shown in this figure, the bottom face 12 of the support 10 has a connector 122, the two assemblies being disposed coaxially, the bottom face 12 of one movable contact assembly and the bottom face 12 of the other movable contact assembly being engaged with each other, achieving the engagement of the contact assemblies with each other.

Figure 4:
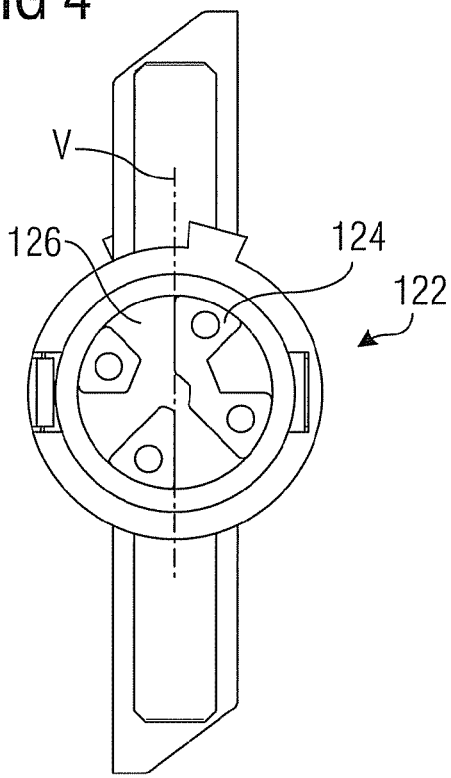
FIG. 4 is a schematic view along the direction F shown in FIG. 3.
Figure 5:
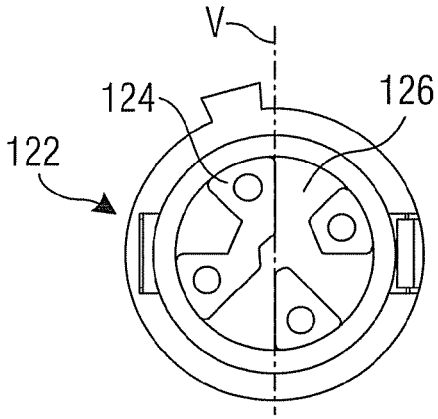
FIG. 5 is a schematic view of the bottom face of the support along the direction R shown in FIG. 3.

FIG. 4 shows a schematic view along the direction F shown in FIG. 3, in which the bottom face of a movable contact assembly is shown. As shown in this figure, the connector 122 has the shape of being disposed symmetrically along the diameter V and being complementary, for example, the connector 122 can comprise a complementary shape, such as a convex tooth 124 and a groove 126 which are disposed symmetrically to the two sides of the diameter V. In addition, FIG. 5 is a schematic view of the bottom face 12 of another movable contact assembly along the direction R shown in FIG. 3, in which the position of the convex tooth 124 and the groove 126 on the connector 122 and the position thereof in FIG. 4 are symmetric with respect to the diameter V, and due to their complementary shape, the convex tooth 124 of FIG. 4 is just insertable into the groove 126 of FIG. 5, likewise, the convex tooth 124 of FIG. 5 is also insertable into the groove 126 of FIG. 4, thus the adjacent bottom faces of the two adjacent movable contact assemblies can be connected securely to each other.

Figure 6:
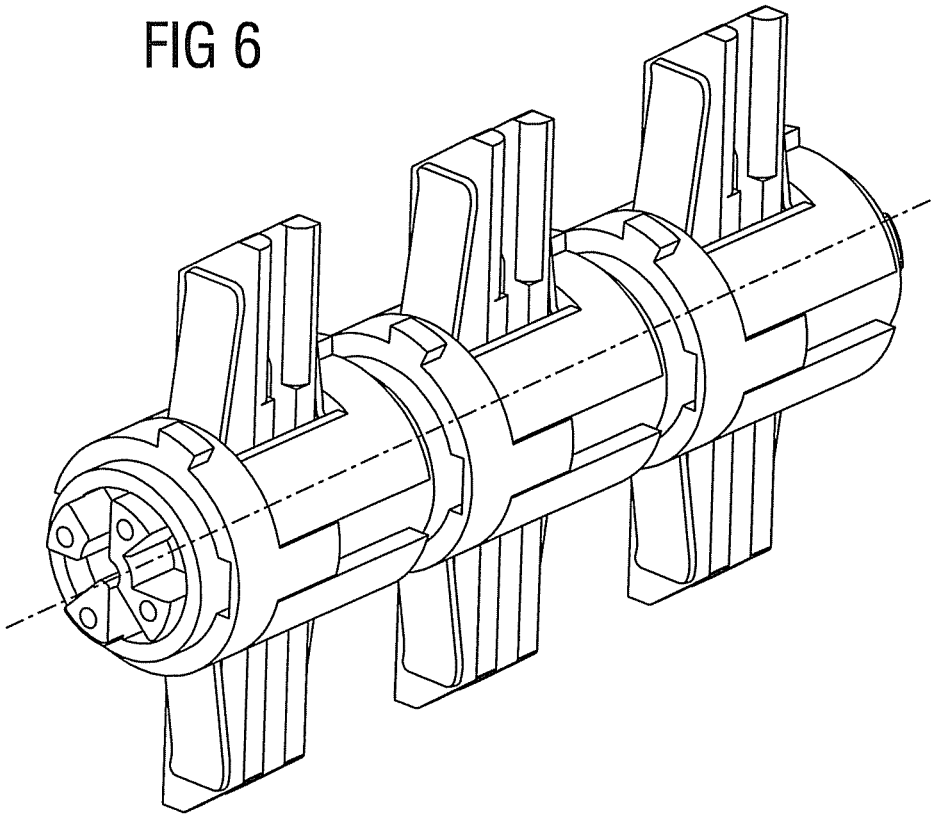
FIG. 6 is a schematic view of three movable contact assemblies shown in FIG. 2 having been assembled.

The movable contact assembly according to an embodiment of the present invention can readily realize a series connection of a plurality of movable contact assemblies. FIG. 6 is the schematic view showing the assembling of a plurality of movable contact assemblies. As shown in the figure, three sets of movable contact assemblies are connected in succession, thus realizing the assembling of the plurality of movable contact assemblies according to the method shown in FIG. 3, so as to satisfy the structural needs of different electrical switches.

Figure 7:
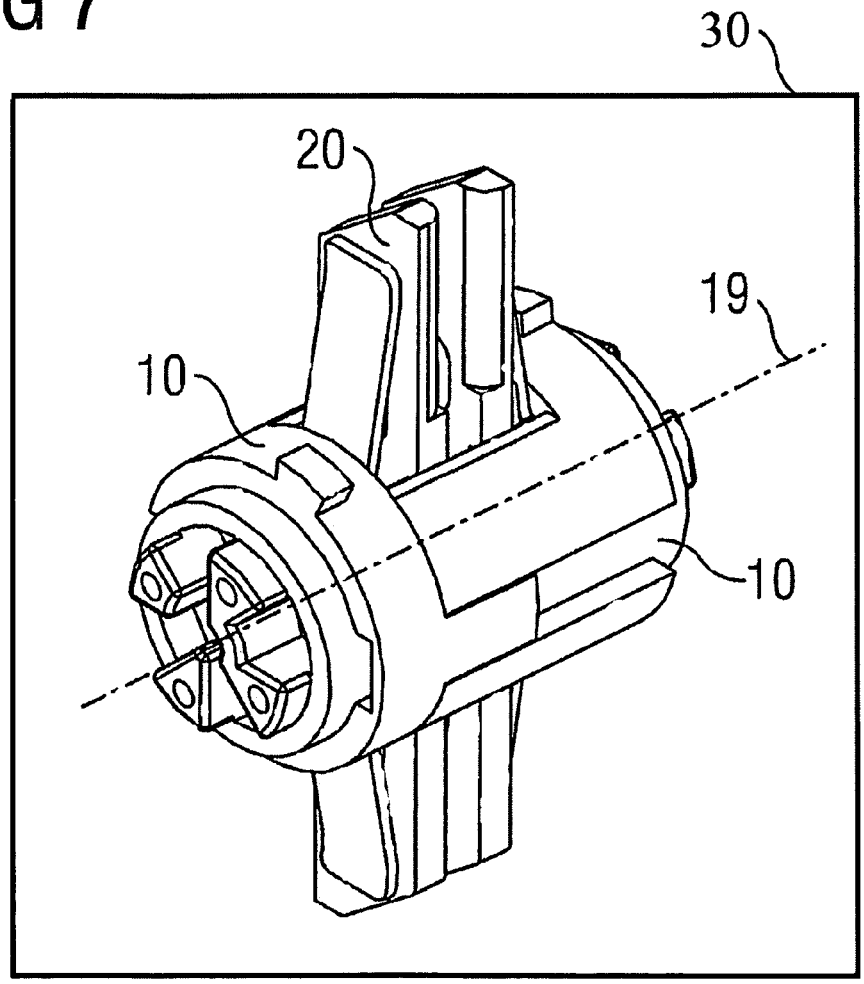
FIG. 7 is a perspective schematic view of the moveable contact assembly shown in FIG. 1 after having been assembled and including an electrical switch.

FIG. 7 shows a structural schematic view of a movable contact assembly formed after having assembled the two supports 10 and a movable contact 20. An electrical switch 30 may include the movable contact assembly.

It can be seen from the foregoing description that, the movable contact assembly for an electrical switch of an embodiment of the present invention, by way of the fitting between the inner hook, the outer hook, the projecting tongue, the recess and the like, has realized the secure assembling of movable contact assembly with fewer parts, and can transmit larger torques, in which the design of the connecting faces satisfies the need of a series connection between a plurality of movable contact assemblies, and at the same time, due to the fitting of the inner hook and the outer hook, the separation between the supports is avoided without using screw-threads. The movable contact assembly is simple in overall structure, low in costs, and capable of being assembled quickly and efficiently.

In addition, due to the shape of the bottom face being complementarily symmetrical radially in the movable contact assembly of an embodiment of the present invention, when in use, any number of movable contact assemblies can be combined together according to different needs. Compared with the currently available movable contact assemblies, it is simpler in structure and lower in costs, and is capable of realizing quick and efficient assembling.

The series of detailed descriptions listed above are only particular descriptions targeting feasible embodiments of the present invention, but which are not to limit the protective scope of the present invention, and all equivalent embodiments or variations without departing from the technical spirit of the present invention should be included within the protective scope of the present invention.

In the following text, including the Patent Claims, the support bodies 11 are replaced by rotating bodies 11, the axis 19 is replaced by the rotation axis 19, the tongue 18 is replaced by the tongue-like projection 18, and the bottom face 12 is replaced by the bottom 12.

In other words, an embodiment of the invention then relates to an electrical switch having a rotatable contact assembly, which comprises a rotatable contact (20) and rotating bodies (11) which are arranged on both sides on the contact (20), wherein the rotating bodies (11) each have a bottom (12) and wherein their common rotation axis (19) runs at right angles to the bottom (12). An embodiment of the invention in this case provides that each rotating body (11) comprises a receptacle (14) for accommodating and holding the movable contact (20), wherein the receptacle (14) extends along the rotation axis (19) and is symmetrical with respect to a diameter of the bottom (12), that is to say it is symmetrical with respect to a center plane/symmetry plane which runs through the rotation axis (19). Furthermore, a pair of hooks (15, 16) which extend along the direction of the rotation axis (19), wherein the outer hook (16) and the inner hook (15) are arranged symmetrically with respect to the diameter (of the symmetry plane) and the shape of the outer hook (16) and the shape of the inner hook (15) are matched to one another such that they correspond for hooking. A projection (18) and a recess (17), which corresponds to the projection (18), are provided and extend along the axis (19), wherein the projection (18) and the recess (17) are arranged symmetrically with respect to the diameter and their shapes correspond to one another, that is to say they are complementary with respect to one another.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A movable contact assembly for an electrical switch, comprising:

a rotatable contact; and rotating bodies arranged on both sides of the rotatable contact, each of the rotating bodies including a bottom face, a common rotation axis of the rotating bodies running at right angles to the bottom face, each rotating body comprises:

a receptacle for accommodating and holding the rotatable contact, wherein the receptacle extends along the common rotation axis and is designed to be symmetrical with respect to a center plane which runs through the common rotation axis;

a pair of hooks which extend along the direction of the common rotation axis, wherein a relatively outer hook and a relatively inner hook, of the pair of hooks, are arranged symmetrically with respect to a diameter, and a shape of the outer hook and a shape of a inner hook corresponding to one another for hooking; and a projection and a recess, the recess corresponding to the projection, the projection and the recess extending along the axis, wherein the projection and the recess are arranged symmetrically with respect to a center plane and wherein shapes of the projection and the recess correspond to one another, wherein the bottom face includes a connector, the connector being positioned symmetrically with respect to the diameter and being complementary in shape, the connector including a plurality of convex tooth and groove pairs, the convex tooth and groove pairs being positioned symmetrically with respect to the diameter and being complementary in shape.

2. The movable contact assembly for an electrical switch as claimed in claim 1, wherein the shape of the projection is arcuate.

3. The movable contact assembly for an electrical switch as claimed in claim 1, wherein the shape of the projection is rectangular.

4. The movable contact assembly for an electrical switch as claimed in claim 1, wherein the shape of the projection is polygonal.

5. An electrical switch comprising the movable contact assembly of claim 1.

* * * * *